US006200154B1

(12) United States Patent
Yu

(10) Patent No.: US 6,200,154 B1
(45) Date of Patent: Mar. 13, 2001

(54) ELECTRICAL SOCKET

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/437,686

(22) Filed: Nov. 10, 1999

(30) Foreign Application Priority Data

May 15, 1999 (TW) ..... 88207773

(51) Int. Cl.[7] ..... H01R 13/625
(52) U.S. Cl. ..... 439/342
(58) Field of Search ..... 439/342, 259–270

(56) References Cited

U.S. PATENT DOCUMENTS 4,420,205 * 12/1983 Kirkman ..... 439/342
4,538,870 * 9/1985 Thewlis ..... 439/342
5,649,836 * 7/1997 Kashiwagi ..... 439/342
5,707,247 * 1/1998 Konstad ..... 439/342
5,855,489 * 1/1999 Walker ..... 439/342

* cited by examiner

*Primary Examiner*—Gary F. Paumen
(74) *Attorney, Agent, or Firm*—Wei Te Chung

(57) ABSTRACT

An electrical socket includes a base, a cover and a cam mechanism. The base has a main body and a slot formed in a corner thereof. A V-shaped cutout is formed in each edge of the main body. An extending block is formed on an edge of each V-shaped cutout. A plurality of passageways is formed in the base for receiving corresponding terminals therein. The cover has a frame, a body and a positioning hole. The positioning hole is formed in the extending block extending from the body and corresponds to the slot. The cam mechanism comprises an actuation portion and a driving portion each having a columnar profile, and the central line of the actuation portion is offset a certain distance from the center line of the driving portion. The actuation portion is received in the positioning hole and the driving portion is received in the slot. The actuation portion forms a groove for receiving a tool to drive the cam mechanism to rotate relative to the base.

2 Claims, 7 Drawing Sheets

ELECTRICAL SOCKET

BACKGROUND OF THE INVENTION

The present invention relates to an electrical socket, and particularly to an electrical socket having a cam mechanism for effectively and properly positioning the socket.

As technology progresses, computers are becoming increasingly compact while the functions thereof are becoming more complicated. For minimizing the volume of a computer, particularly a notebook computer, elements mounted on a main circuit board should be designed to have a low profile. A CPU socket is the component needing its profile to be lowered. Related inventions concerning the CPU socket are disclosed in Taiwan Patent Application Nos. 82214483 and 83200106.

The conventional electrical socket usually comprises a base, a cover, a driving mechanism and a plurality of terminals. A plurality of passageways is formed in the base for receiving terminals therein. The cover is mounted on a surface of the base and forms a plurality of passageways for receiving contacts of a CPU module. The contacts of the CPU module are inserted through the cover for electrically contacting corresponding terminals of the base. The driving mechanism comprises a connection portion and an actuation arm. The actuation aim is pivotally connected to the base for displacing the cover relative to the base, and the contacts of the CPU module can engage with and disengage from the corresponding terminals of the base. However, the actuation arm of the conventional socket occupies a significant space above the circuit board. In addition, the electrical socket occupies too much space and has a high profile, but if the actuation arm is shortened a sufficient driving moment can not be provided to displace the cover. Thus, an improved driving mechanism for an electrical socket is requisite.

BRIEF SUMMARY OF THE INVENTION

A main object of the present invention is to provide an electrical socket having a space efficient cam mechanism for displacing contacts of a CPU module between insertion and withdrawal positions relative to terminals of the socket thereby promoting a conservation of circuit board space.

To fulfill the above-mentioned object, according to a preferred embodiment of present invention, an electrical socket comprises a base, a cover and a cam mechanism. The base has a main body and a slot formed in a corner thereof. A V-shaped cutout is formed in each edge of the main body. An extending block is formed on an edge of each V-shaped cutout and on a pair of diagonal corners. A plurality of passageways is formed in the base for receiving corresponding terminals therein. The cover has a frame, a body and a positioning hole. The positioning hole is formed in an extending block extending from the body and corresponds to the slot. The cam mechanism comprises an actuation portion and a driving portion each having a columnar profile, and the center line of the actuation portion has a certain distance with the center line of the driving portion. The actuation portion is received in the positioning hole and the driving portion is received in the slot. The actuation portion forms a groove for receiving a tool to drive the cam mechanism to rotate relative to the base. Other objects, advantages and novel features of the invention will become more apparent from the following detailed description when taken in conjunction with the accompanying drawings.

DETAILED DESCRIPTION OF THE INVENTION

Figure 1:
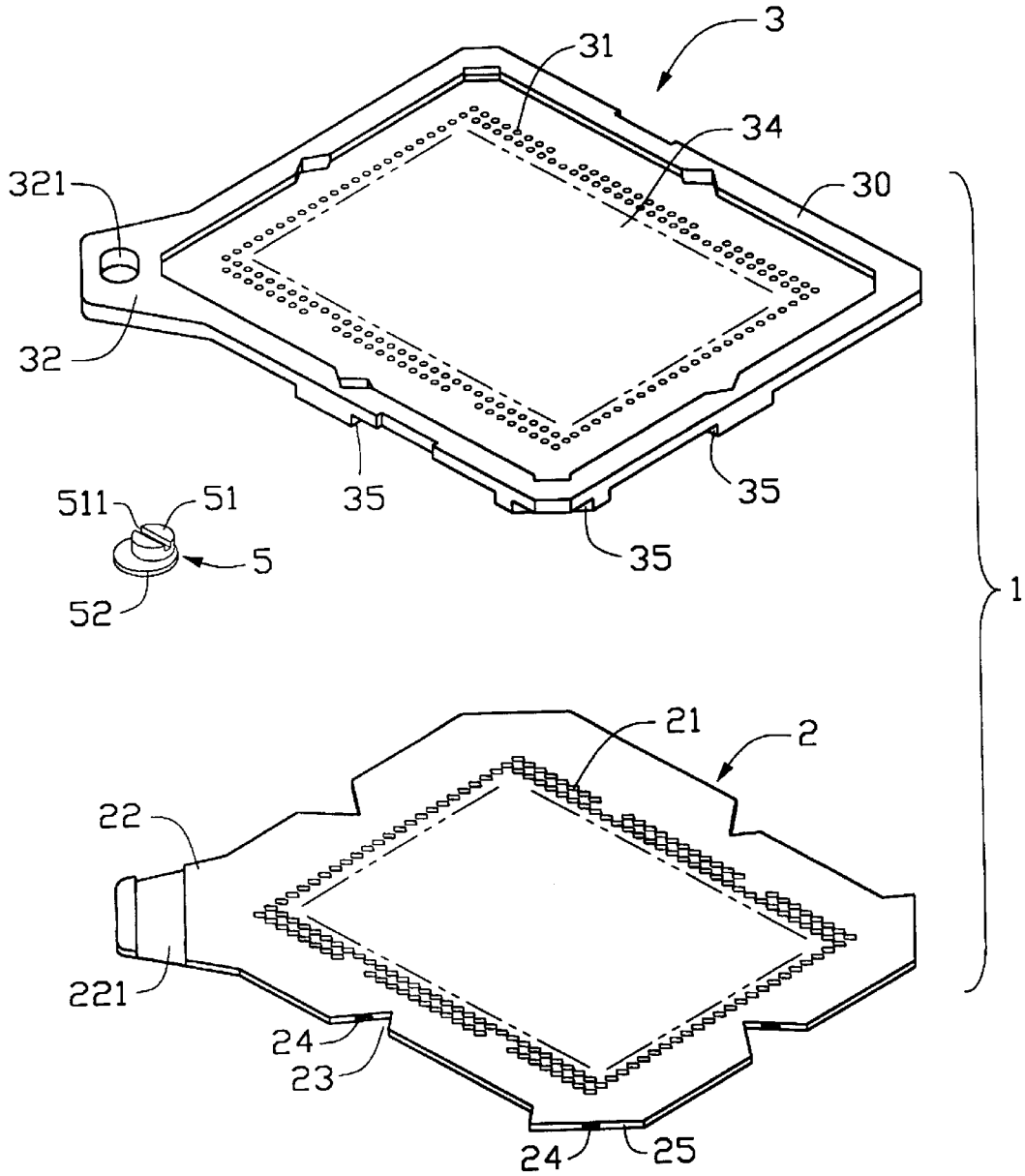
FIG. 1 is a perspective exploded view of an electrical socket in accordance with the present invention.

Referring to FIG. 1, an electrical socket 1 comprises a base 2, a cover 3 and a cam mechanism 5. The base 2 has a main body 22 and a slot 221 formed in a corner thereof. A V-shaped cutout 23 is formed in each edge of the main body 22. An extending block 24 is formed on an edge of each V-shaped cutout 23 and on a pair of diagonal corners 25. A plurality of passageways 21 is formed in the base 2 for receiving corresponding terminals (not shown) therein.

The cover 3 has a frame 30, a body 34 and a positioning hole 321. The positioning hole 321 is formed in an extending block 32 extending from the body 34 and corresponds to the slot 221. The cam mechanism 5 is received in the positioning hole 321 and the slot 221 for controlling the movement of the cover 3 relative to the base 2. A plurality of passageways 31 is formed in the body 34 for receiving corresponding contacts of a CPU module (not shown). A plurality of projections 35 is formed on the frame 30 for engaging with the corresponding V-shaped cutouts 23. Each projection 35 forms a channel (not shown) for receiving the corresponding extending block 24. When the cover 3 moves relative to the base 2, the extending block 24 moves within the channels of the corresponding projection 35.

Figure 2:
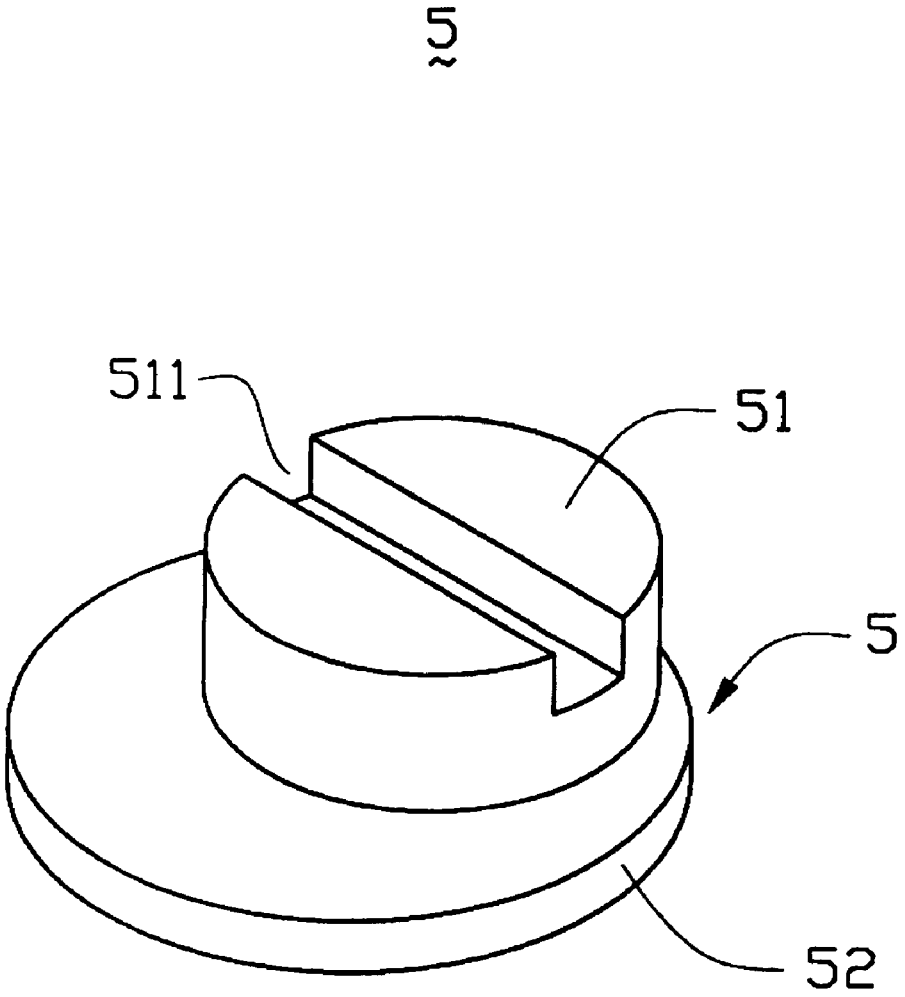
FIG. 2 is a perspective view of a cam mechanism in accordance with the present invention.

Referring to FIG. 2, the cam mechanism 5 comprises an actuation portion 51 and a driving portion 52 each having columnar profile, and the center line of the actuation portion 51 is offset a certain distance from the center line of the driving portion 52. The actuation portion 51 is received in the positioning hole 321 and the driving portion 52 is received in the slot 221 wherein the dimension of the positioning hole along the diagonally moving direction of the cover 3 is generally equal to the diameter of the actuation portion 51 while the dimension of the slot 221 along the diagonally moving direction of the cover 3 is either equal to or larger than the diameter of the driving portion 52. Additionally, the actuation portion 51 forms a groove 511 for receiving a tool.

Figure 3:
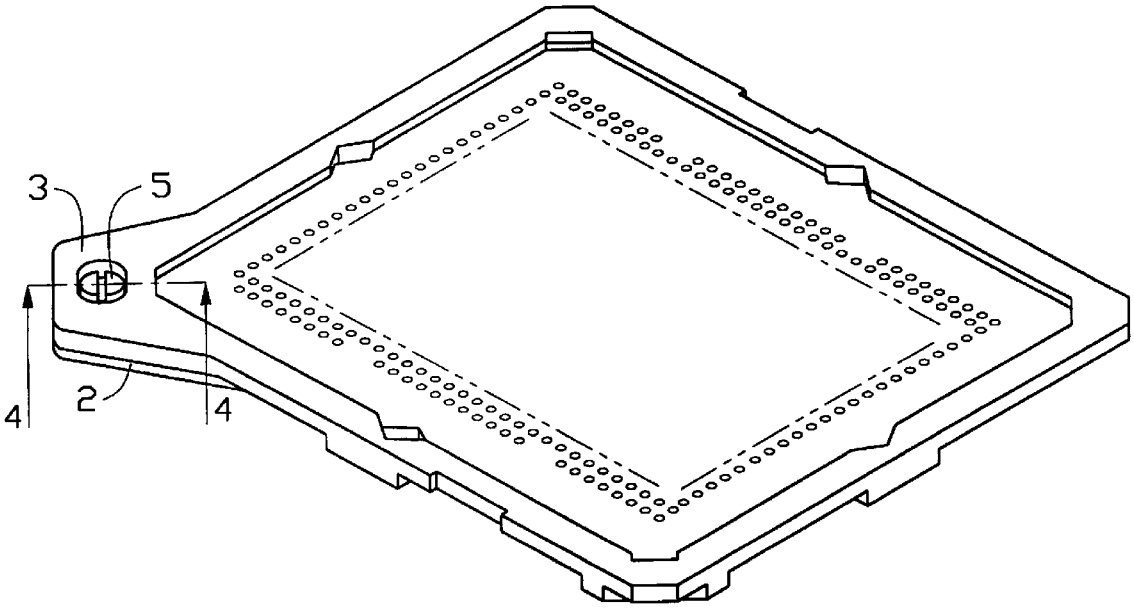
FIG. 3 is a perspective view of the assembled electrical socket.
Figure 4:
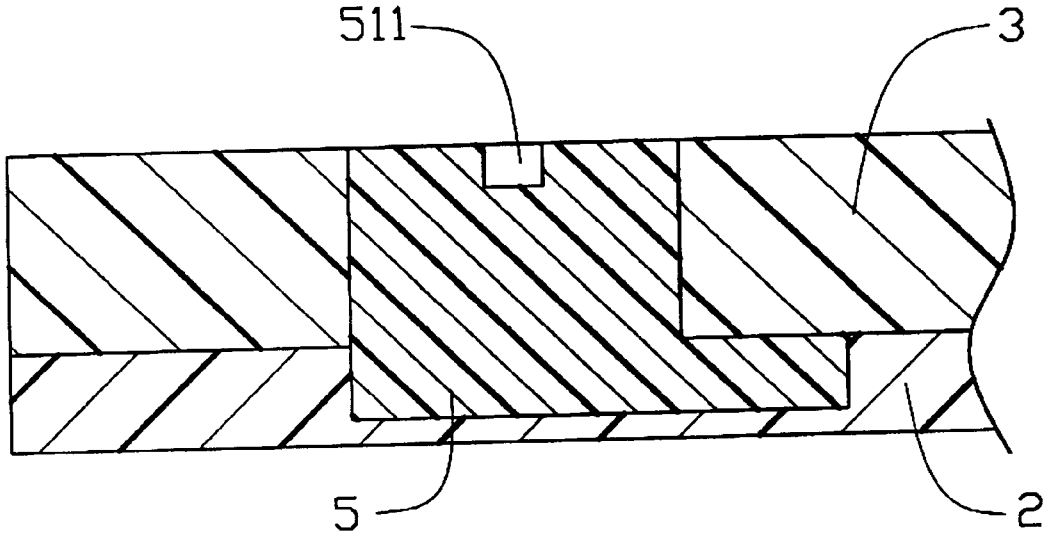
FIG. 4 is a cross-sectional view taken along line 4—4 of FIG. 3.

Referring to FIGS. 3 and 4, in assembly, the cover 3 is positioned on the base 2, the actuation portion 51 of the cam mechanism 5 is inserted into the positioning hole 321, the driving portion 52 is received in the slot 221, and the extending blocks 24 slidable received in the channels of the corresponding projections 35. An external tool is inserted into the groove 11 to drive the cam mechanism 5 to rotate relative to the base 2. Since the base 2 is soldered to a circuit board (not shown) and can not be moved, the cover 3 is driven by the tool and is displaced relative to the base 2. Thus, the contacts of the CPU module can be displaced between insertion and withdrawal positions relative to the terminals of the base 2.

Figure 5:
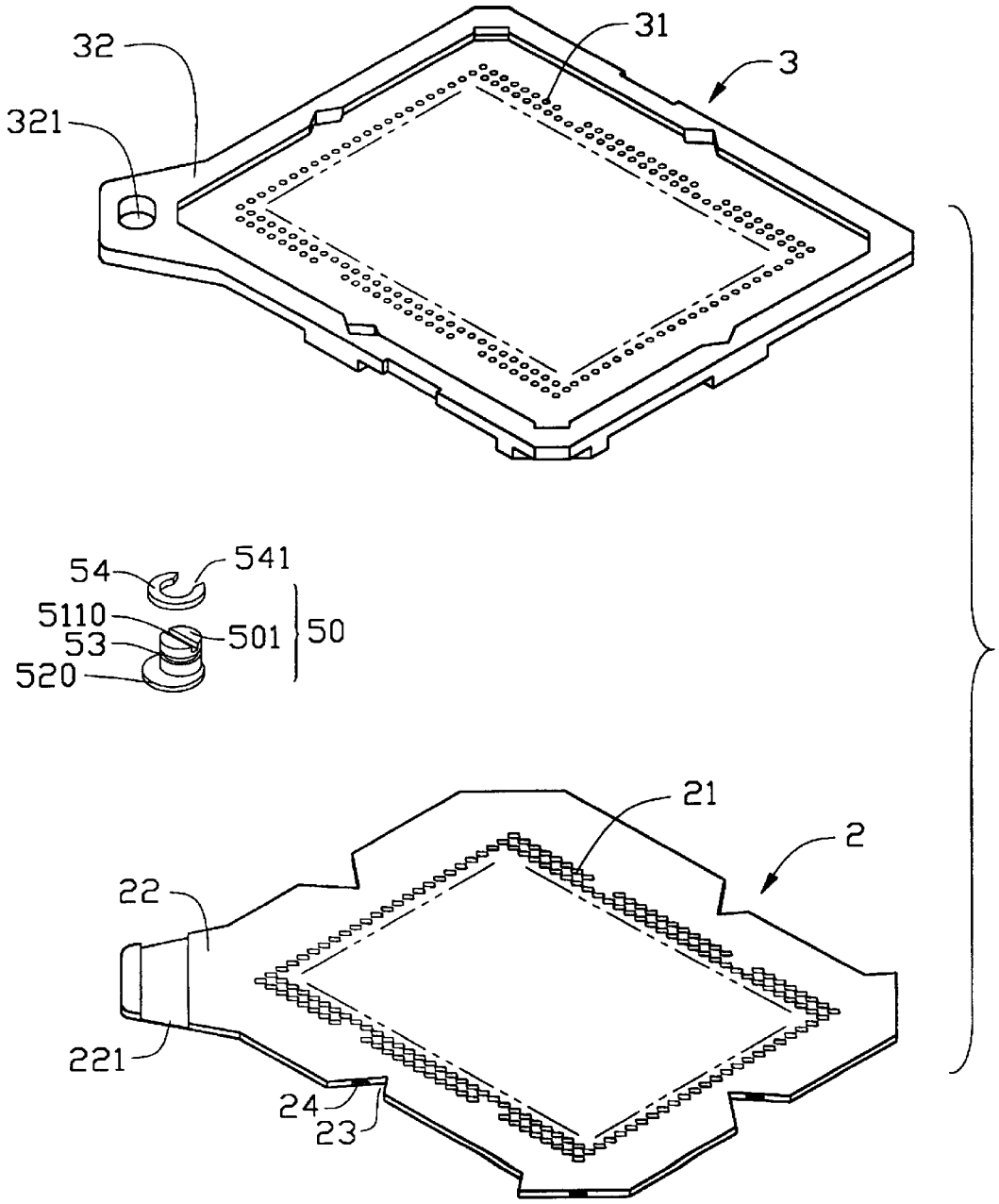
FIG. 5 is a perspective exploded view of a socket in accordance with another embodiment of the invention.
Figure 6:
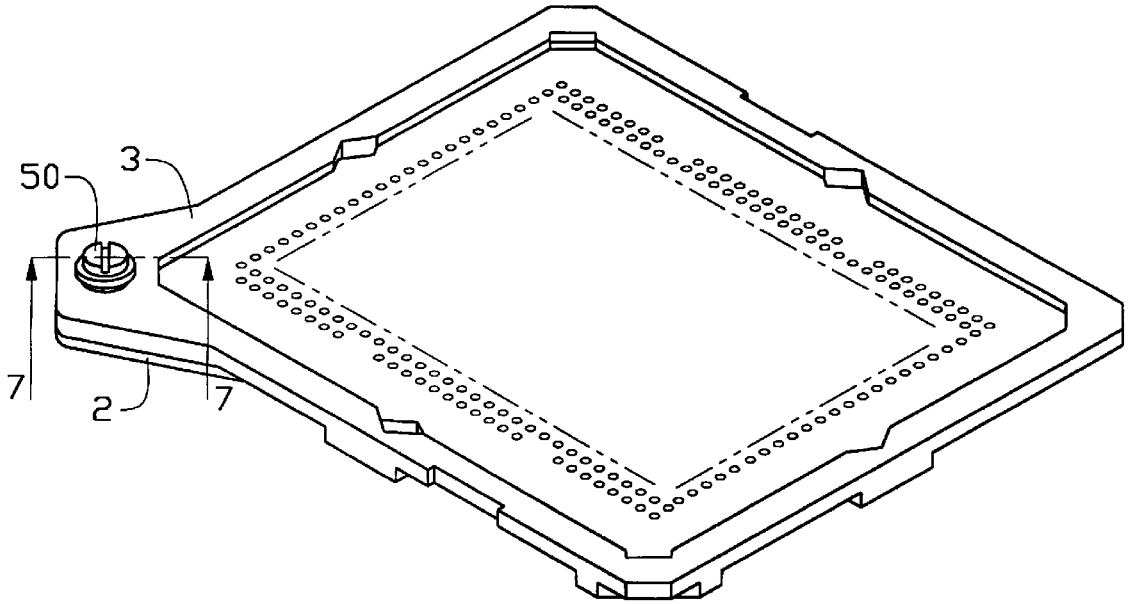
FIG. 6 is an assembled view of FIG. 5.
Figure 7:
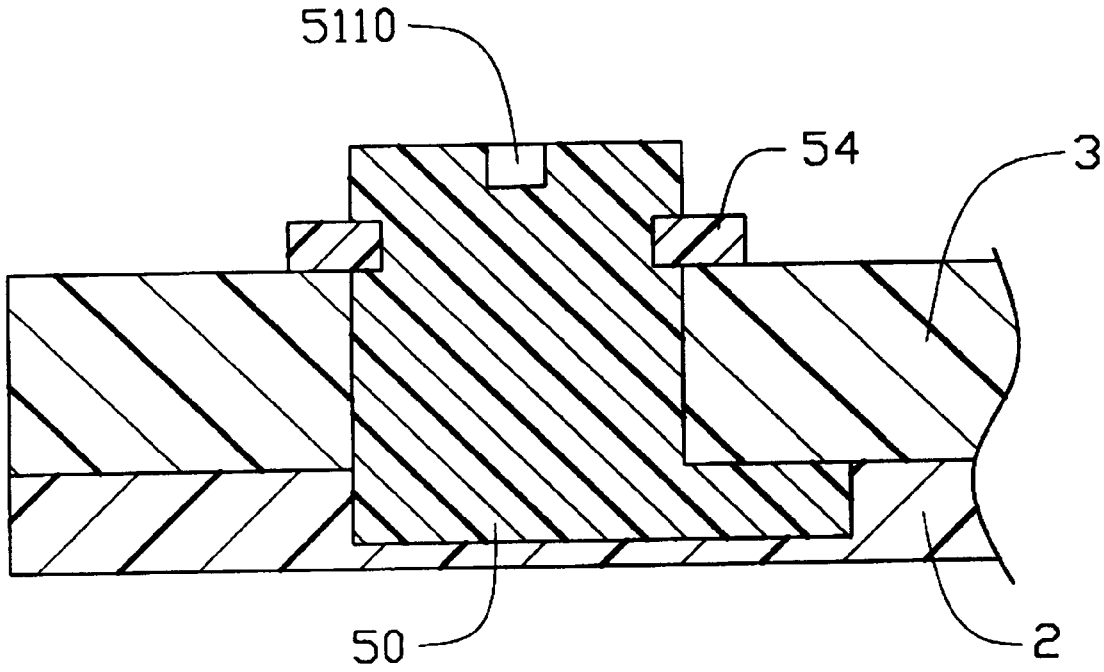
FIG. 7 is a cross-sectional view taken along line 7—7 of FIG. 6.

FIGS. 5 to 7 illustrate another embodiment of the present invention. The socket comprises a cover 3, a cam mechanism 50 and a base 2. The cam mechanism 50 comprises an actuation portion 501 and a driving portion 520. A recess 53 is formed around a middle section of the actuation portion 501 for receiving a resilient ring 54. The outer diameter of the resilient ring 54 is larger than that of the actuation portion 501. The resilient ring 54 forms a cutout 541 for facilitating assembly. The ring 54 functions as a stop for preventing an upward deflection of the cover 32 when the driving portion 501 of the cam mechanism 50 pushes the cover 32 relative to the base 2 between open and closed positions. The driving portion 520 is mounted in a slot 221 and an external tool is inserted into a groove 5110 formed in the actuation portion 501 to drive the cam mechanism 50 to rotate. Thus, the cover 3 is displaced relative to the base 2. Therefore, compared to a conventional socket, circuit board space occupied by the socket of the present invention is conserved.

It is noted that in the first embodiment, because the dimension along the transverse direction of either the positioning hole 321 or the slot 221 is relatively larger than the diameter of the corresponding actuation portion 51 or the driving portion 52, it may allow transverse movement of either the actuation portion 51 or the driving portion 52 with regard to either the positioning hole 321 or the slot 221 when the cover 3 is diagonally moved with regard to the base 2. It is understood that this relatively larger dimension of either the positioning hole 321 or the slot 221 relative to the corresponding actuation portion 51 or driving portion 52 is to compensate the derived transverse movement of the actuation portion 51 or the driving portion 52 in the corresponding positioning hole 321 or slot 221 without interference therebetween when the cover 3 is diagonally moved with regard to the base 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket comprising:

a base having a main body, a plurality of passageways formed in the main body for receiving contacts, a slot formed in a corner of the base, each edge of the main body forming a V-shaped cutout and an extending block formed on an edge of the V-shaped cutout;

a cover being slidably mounted on the base, the cover comprising a body, a frame formed around the body, a block extending from a corner of the frame and forming a positioning hole corresponding to the slot of the base, and a plurality of passageways formed in the body for receiving corresponding terminals of a CPU module; and a cam mechanism having an upper actuation portion and a lower driving portion, the actuation portion being rotatably received in the positioning hole of the cover, the driving portion being moveably received in the slot of the base;

wherein a plurality of projections is formed on the frame and each projection has a channel for receiving the corresponding extending block formed on the V-shaped cutout;

further comprising a resilient ring, and wherein the actuation portion forms a circumferential recess for receiving the resilient ring;

wherein a groove is formed in a top surface of the actuation portion for receiving an external tool to drive the cam mechanism to rotate relative to the cover;

wherein the outer diameter of the resilient ring is larger than that of the actuation portion whereby the cover is positioned by the resilient ring;

wherein the central axis of the actuation portion is offset a distance from the central axis of the driving portion.

2. A electrical socket comprising:

base having a main body with a plurality of first passageways therein, a slot formed at a corner thereof;

a cover slidably mounted to said base diagonally, the cover comprising a body with a plurality of second passageways generally in alignment with the corresponding first passageways, respectively, a block formed on a corner of the body and defining therein a positioning hole generally in alignment with the slot;

a cam mechanism defining an upper actuation portion and a lower driving portion each having columnar profile, a center line of the actuation portion being offset a certain distance from that of the driving portion, the actuation portion being received in the positioning hole and the driving portion being received in the slot; wherein said cam mechanism includes movements along both a diagonally moving direction of the cover with regard the base and a transverse direction perpendicular to said diagonally moving direction when said cover is diagonally moving with regard to the base along said diagonally moving direction;

further comprising a resilient ring, and wherein the actuation portion forms a circumferential recess for receiving the resilient ring;

wherein the outer diameter of the resilient ring is larger than that of the actuation portion whereby the cover is positioned by the resilient ring;

wherein a dimension of the positioning hole along said diagonally moving direction of the cover with regard to the base is generally equal to a diameter of the actuation portion while another dimension of the slot along said same diagonally moving direction of the cover with regard to the base is either equal to or larger than another diameter of the driving portion;

wherein a dimension of the slot along said transverse direction is larger than a diameter of the driving portion;

wherein a dimension of the positioning hole along said transverse direction is larger than a diameter of the actuation portion.

* * * * *